US007167660B2

(12) United States Patent
Gilmore

(10) Patent No.: US 7,167,660 B2
(45) Date of Patent: Jan. 23, 2007

(54) STANDBY TEMPERATURE CONTROL TO MINIMIZE FUSER DROOP AND OVERSHOOT

(75) Inventor: James Douglas Gilmore, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 157 days.

(21) Appl. No.: 10/809,652

(22) Filed: Mar. 25, 2004

(65) Prior Publication Data

US 2005/0214013 A1 Sep. 29, 2005

(51) Int. Cl.
*G03G 15/20* (2006.01)

(52) U.S. Cl. ..... 399/69; 399/70

(58) Field of Classification Search ..... 399/67, 399/69, 70, 328, 330, 68; 219/216
See application file for complete search history.

(56) References Cited

U.S. PATENT DOCUMENTS

| | | | | |
|---|---|---|---|---|
| 4,551,007 | A * | 11/1985 | Elter | 399/69 |
| 6,016,410 | A * | 1/2000 | Aslam et al. | 399/69 |
| 6,298,216 | B1 * | 10/2001 | McMindes et al. | 399/330 |
| 2004/0042810 | A1 * | 3/2004 | Cho | 399/69 |

* cited by examiner

*Primary Examiner*—Hoang Ngo
(74) *Attorney, Agent, or Firm*—Stevens & Showalter, LLP

(57) ABSTRACT

A method of operating an electrophotographic printer and particularly the fuser thereof, includes preheating a heated roller of the fuser to a preheat temperature greater than the maximum target temperature for fusing, but less than the maximum temperature of a temperature range for proper fusing. During prolonged standby, the heated roller is heated to a standby temperature greater than the maximum target temperature, but less than the maximum temperature of the temperature range for proper fusing.

21 Claims, 4 Drawing Sheets

STANDBY TEMPERATURE CONTROL TO MINIMIZE FUSER DROOP AND OVERSHOOT

BACKGROUND OF THE INVENTION

1. Field of the Invention

The present invention relates generally to electrophotographic printing devices, and, more particularly, to the operation of the heating units in a fuser roll and control of standby temperatures of the fuser roll between print jobs.

2. Description of the Related Art

In the electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to the media intended to receive the final permanent image. The toner image is fixed to the media by the application of heat and pressure in a fuser.

A fuser is known to include a heated roll and a backup roll defining a nip through which the media passes. During the fusing process, it is necessary that sufficient heat be applied to the toner particles so that the toner is permanently affixed to the media. If the temperature is too low, the under-fused toner can smear, transfer to printing apparatus surfaces or otherwise degrade the quality of the currently printed media and even subsequent printings. Adequate fusing temperatures are quite high, and therefore it is necessary to maintain the heated roll at an elevated standby temperature between print jobs, so that printing is not delayed excessively while the fuser is heated to an acceptable fusing temperature. It is also necessary that the heated roll is not heated excessively, since excessive fuser roll temperatures can cause hot offset and wrap of the media on the fuser roll. The need to maintain the fuser temperature above the minimum and below a maximum temperature, which may be a relatively small temperature window, can cause delays as the fuser roll is warmed or allowed to cool as necessary.

It is known to provide fuser rolls made of aluminum cores with elastomeric coverings. While such structures work well for a number of reasons, including sheet release properties of the elastomeric cover, the relatively poor thermal conductivity through the structures provides other challenges in maintaining desired printing temperatures without unduly delaying print jobs.

When relatively small print jobs are processed, such as jobs entailing one to five printed pieces of media, a condition of overshoot can occur, in which the fuser roll becomes hotter than desired after the print job is completed. As media passes through the fuser nip, heat is transferred from the surface of the heated roll to the media. The temperature control system in the printing apparatus detects the decreasing temperature, and activates heating lamps or other devices to provide additional heat to the fuser roll. Heat is absorbed by the aluminum core of the roller and is transferred from the core to the elastomeric layer, increasing the surface temperature of the roller. However, because of the relatively poor thermal conductivity of the elastomeric layer, and the large heat capacity of the aluminum core, heat transfer can be slow. When a small print job occurs, the job may complete and media cease passing through the fuser at the end of the print job before significant heat transfer occurs from the core to the elastomer layer. Since passing media is no longer sinking heat from the elastomer, the excess energy stored in the core transfers to the elastomer, producing a substantial rise in surface temperature after a small print job has been completed. The rise or overshoot may be well in excess of the maximum temperature for successful operation.

When overshoot occurs, the roller must be allowed to cool before another print job starts, to avoid the possible hot offset and media wrap problems mentioned previously. This can cause a significant time lag between print jobs, as the roller is allowed to cool. The only cooling mechanism available to the fuser is free convection cooling, and since the elastomeric roll cover has relatively poor thermal conductivity, cooling is slow and may require six to ten seconds for each one degree Centigrade of cooling required. Therefore, it is desirable that overshoot be eliminated or reduced to minimize print quality and first copy time delays.

Relatively complex control algorithms have been developed for processing print jobs, and to control heating to minimize overshoot at the end of the print job. Such algorithms have worked well for large print jobs; however, for shorter print jobs, the predictive nature of such algorithms does not have sufficient time or information to adequately affect the magnitude of overshoot at the end of the small print job. Such algorithms require some forehand knowledge of job size and the number of pages remaining to be printed. However, many current print managers for the print engine and raster image processor (RIP) interface may only cue up four sheets at a time. If more sheets are in the pipeline, the engine is not aware of them until a page is emptied from the cue. Also, the RIP sends information as it receives it, not when it has completely processed the job. Thus, the engine must continuously check to see if the RIP has sent new information or pages. The uncertainty of the number of pages left in the page manager pipeline or the need to hold off declaring the end of a print job results in less than optimal performance when the overshoot reduction algorithm functions for short print jobs.

Since the standard print job in many applications of printing apparatuses is three sheets or less, a need exists to minimize fuser temperature overshoot and to improve the first page print performance of printers processing print jobs of five sheets or less.

What is needed in the art is a control sequence or algorithm to minimize temperature overshoot and to control fuser roll standby temperatures so as to improve first page performance of electrostatic printing apparatuses printing small print jobs.

SUMMARY OF THE INVENTION

The present invention provides a control algorithm which improves first page print performance and reduces temperature overshoot by increasing standby fuser roll temperature to a temperature higher than normal target printing temperatures, thereby delaying the start of heating and reducing the overshoot at the end of short print jobs.

The invention comprises, in one form thereof, a method for fusing toner on media in an electrophotographic printing apparatus with steps of heating the heated roll to a preheated temperature within a temperature range, the preheated temperature being in excess of a first maximum target temperature; interrupting the heating prior to commencement of a fusing operation; commencing the fusing operation by passing media between the heated roll and the backing structure; and initiating reheating of the heated roll during the fusing operation only upon a temperature of the heated roll dropping below the first maximum target temperature.

In another form thereof, the invention provides a temperature control method for a fuser having a temperature range for proper fusing and a maximum target temperature within the range. The method has steps of sensing a temperature of the heated roll during a standby period between completion of a first print job and commencement of a second print job; and activating the heater during the standby period to elevate the temperature of the heated roll to a standby temperature within the temperature range, the standby temperature being greater than the maximum target temperature.

In still another form thereof, the invention provides a temperature control procedure for a fuser, with steps of initiating startup of the fuser by heating the fuser roll to a preheat temperature within a temperature range for successful fusing; supplying additional energy for heating the heated roll during a fusing operation only upon the temperature thereof falling below a target temperature lower than the preheat temperature; and heating the heated roll to a standby temperature during a standby period between completion of a first print job and commencement of a subsequent print job, the standby temperature being within the temperature range and being greater than the first target temperature.

An advantage of the present invention is providing a simple control algorithm that works well for small print jobs to reduce temperature overshoot and temperature droop for the fuser roll.

Another advantage is providing a control algorithm for heating a fuser roll efficiently.

Yet another advantage is shortening the delay before printing each print job in a sequence of short print jobs.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
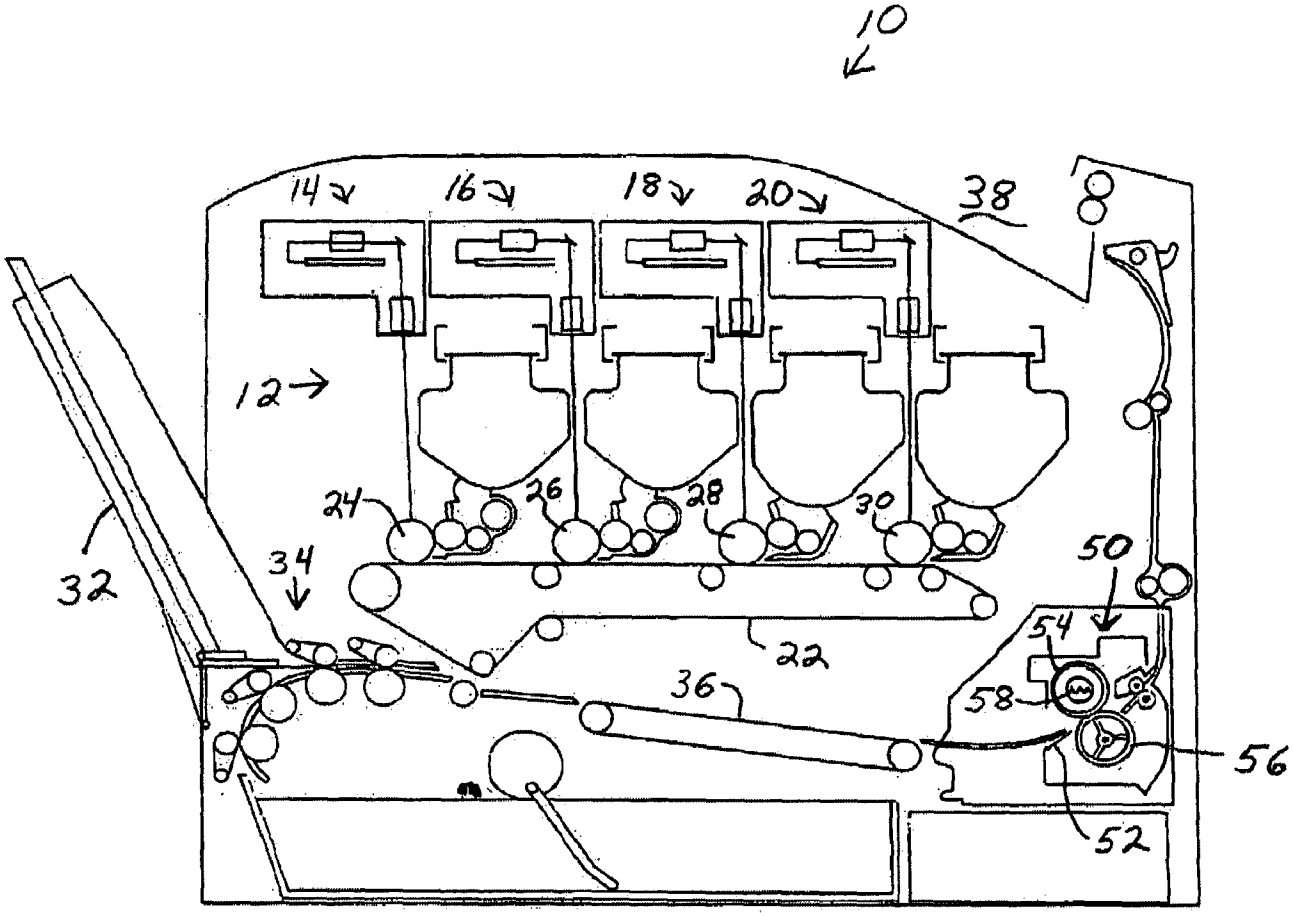
FIG. 1 is a schematic illustration of a printer for which the present invention can be used.

Referring now to the drawings and particularly to FIG. 1, there is shown an embodiment of an electrophotographic (EP) printing apparatus 10 of the present invention. Apparatus 10 is shown in the form of an EP printer 10; however, those skilled in the art should understand readily that the present invention also can be used advantageously on a copy machine or other printing device utilizing the EP process.

Printer 10 includes a print engine 12 having a plurality of color imaging stations 14, 16, 18 and 20 which apply toner particles of a given color to print media at selected pixel locations. In the embodiment shown, printer 10 is a color printer having print color imaging stations for applying black, yellow, magenta and cyan color toners to the media. It should further be understood that the present invention can also be used in a black and white print apparatus having a single imaging station for applying black toner to the media. While individual imaging stations 14, 16, 18 and 20 can apply the appropriate toner particles directly to the media, EP printer 10 is shown having an intermediate transport member 22 which receives toner particles from PC drums 24, 26, 28 and 30 in imaging stations 14, 16, 18 and 20, respectively. Intermediate transport member 22 transfers the toner image to media passing along a media path defined by various rolls and guiding surfaces through printer 10. The components of imaging stations 14, 16, 18 and 20 and the manner in which toner images are generated and applied to intermediate transport member 22, are well known to those skilled in the art and will not be described in further detail herein.

Media is provided in a media supply tray 32 from which individual pieces of media are removed by a media pick mechanism and guided along a media path through printer 10 defined by various rolls, guiding surfaces and a media transport member 36, finally to be discharged into an output bin 38.

Figure 2:
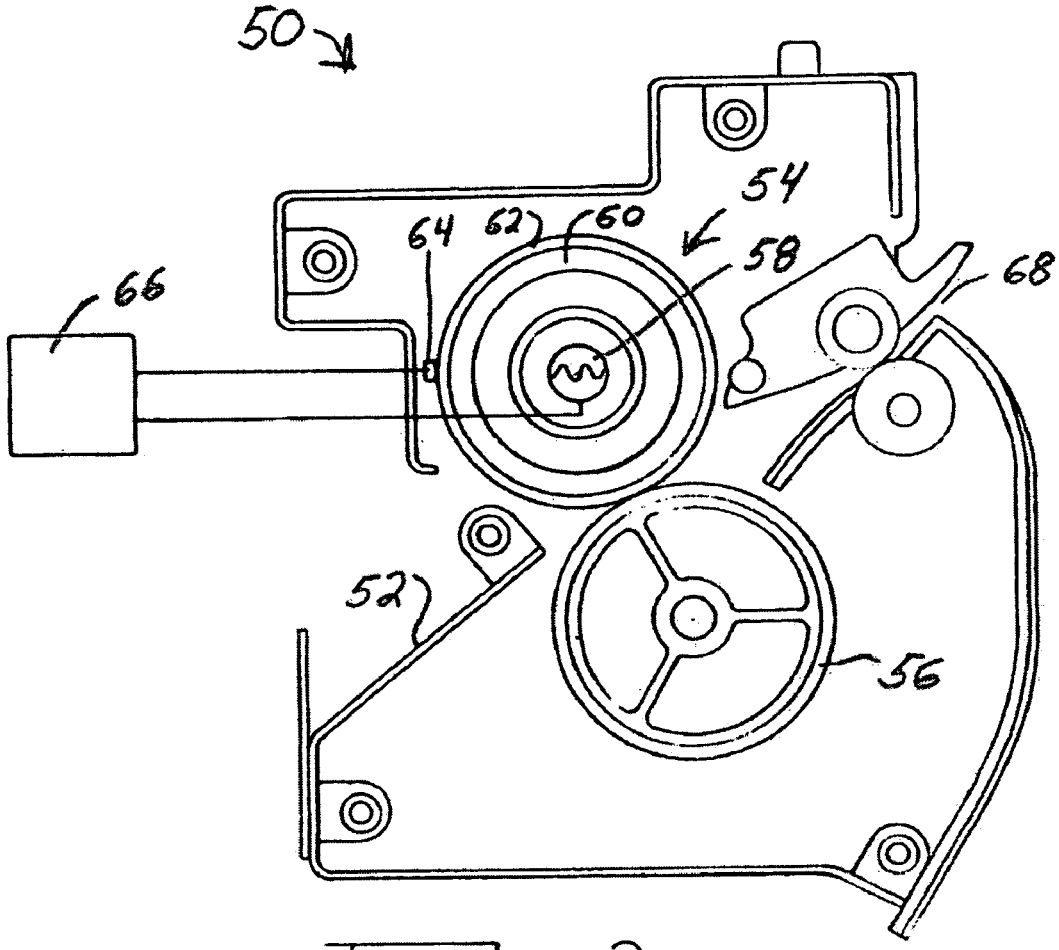
FIG. 2 is a schematic illustration of the fuser section in the printer of FIG. 1.

Along the media path through printer 10, after receiving the toner image thereon, each piece of media is passed through a fuser assembly 50 in which the toner image is permanently affixed to the media by the application of heat and pressure. Media is guided into fuser assembly 50 by an entry guide 52 and is directed between a pair of nipped rolls including a heated roller 54 and a pressure roller 56. The nipped relationship between heated roller 54 and pressure roller 56 applies the required pressure for fusing toner particles to the media. Heated roller 54 is heated by a heating apparatus, such as a halogen lamp 58 in the interior of heated roller 54. Heated roller 54 includes a body 60 (FIG. 2) of aluminum or the like and an elastomeric cover 62, which may include a layer of release material such as a PFA sleeve. Energy applied to halogen light 58 is absorbed as heat energy in body 60 and conducted therethrough to elastomer cover 62 to provide a surface temperature on heated roller 54 sufficient to properly fuse the toner particles to the media. A temperature sensor 64 is provided to detect the surface temperature on elastomeric cover 62, and to provide information thereof to a controller 66. Controller 66 is operatively connected to halogen lamp 58 for activating and deactivating halogen lamp 58 to provide energy input to heated roller 54 in response to changes in the temperature detected at the surface of elastomeric cover 62 as sensed by temperature sensor 64. An exit path 68 is defined from fuser assembly 50 for guiding media therefrom.

As known to those skilled in the art, fuser assembly 50 is designed to operate within a temperature range for heated roller 54 between a maximum and a minimum temperature. The minimum temperature is selected so as to adequately fuse toner particles to the media, and the maximum temperature is selected in conjunction with the characteristics of the toner to properly fuse the toner to the medium while eliminating the potential for hot transfer, media wraps and the like. One or more target temperatures are provided within the temperature range and may vary depending on the type of media being processed through EP printer 10. The target temperature or target temperatures are within the temperature range, below the maximum temperature and above the minimum temperature of the temperature range.

To minimize overshoot for printing short jobs, generally those including five pieces of media or less, it is desirable to reduce the excess power transferred to the fuser rollers by halogen lamp 58. Upon startup of EP printer 10, halogen lamp 58 is activated to heat heated roller 58. Energy is applied thereto until a surface temperature on elastomeric cover 62 is determined by temperature sensor 64 and controller 66 to be substantially at a preheat temperature which is greater than the highest target temperature for fusing. However, the preheat temperature is still within the operable temperature range so that toner can be properly fused to the media at the preheat temperature without the detrimental effects that occur if the temperature range is exceeded. However, as soon as a print job is commenced, controller 66 is adjusted such that operation of halogen lamp 58 is controlled and regulated to a first target temperature less than the preheat temperature. As a result, a delay occurs from the commencement of a fusing operation to the first activation of halogen lamp 58 for reheating heated roller 54 as heat is transferred therefrom to the media passing through fuser assembly 50. As compared with known control systems in which the preheat temperature is the fusing target temperature. Activation of halogen lamp 58 is delayed. Since additional reheating is terminated at the end of a print job, less energy is added to the system during a short print job in accordance with the present invention than in accordance with known prior art. Thus, the potential for overshoot is decreased since less energy is added and the continued heat transfer that occurs from body 60 to elastomeric cover 62 after completion of the print job is reduced.

In accordance with a further aspect of the present invention, during a standby period between completion of a first print job and commencement of a second print job, halogen lamp 58 is activated to provide energy to the system, thereby heating heated roller 54 to a standby temperature. In accordance with the present invention, the standby temperature also is in excess of the maximum target temperature for heated roller 54. The standby temperature also is within the operable temperature range so that fusing can be started immediately at the standby temperature. The standby temperature can be the same as the preheat temperature.

Upon commencement of a second print job after a standby temperature has been reached, a similar occurrence results as described above for the start of a first print job. Reheating of heated roller 54 is delayed in that the temperature of heated roller 54 is above the target temperature. Again, for short print jobs, less energy is applied to the system and the potential for overshoot upon completion of the print job is reduced.

Since some excess energy may remain in the system upon completion of a print job, which results in increasing temperature in heated roller 54 even after a print job has been completed, reheating to the standby temperature is delayed for a period of time after completion of a print job. A delay of thirty seconds has been found to be appropriate in common applications of the present invention.

The difference between the preheat temperature or the standby temperature and the maximum target temperature should be at least about 5° C. For lower target temperatures used for fusing toner to some media, the difference between the preheat temperature or the standby temperature and such lower target temperature will, of course, be greater.

Figure 3A:
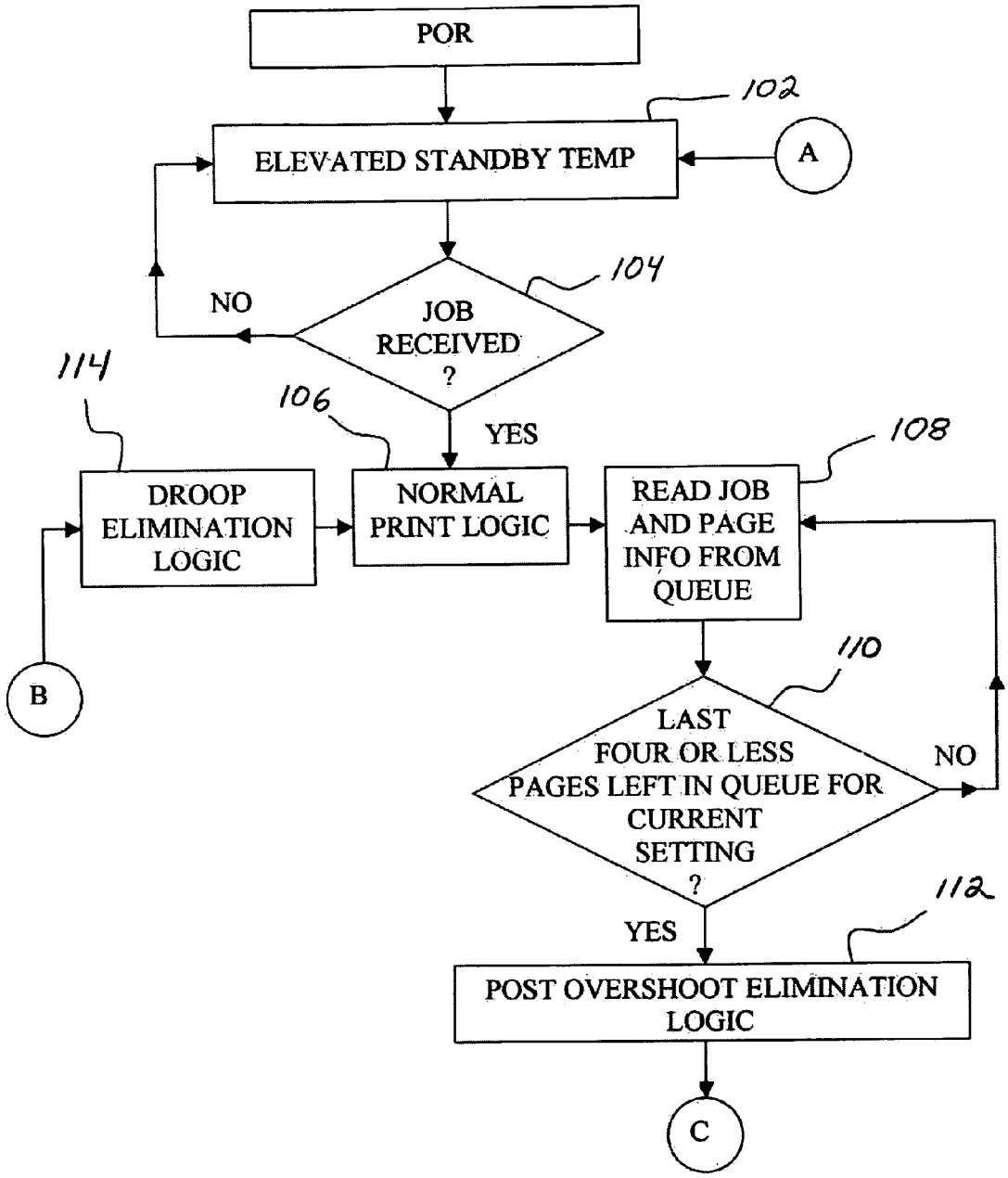
FIGS. 3A and 3B are a diagram of the control logic in accordance with the present invention.
Figure 3B:
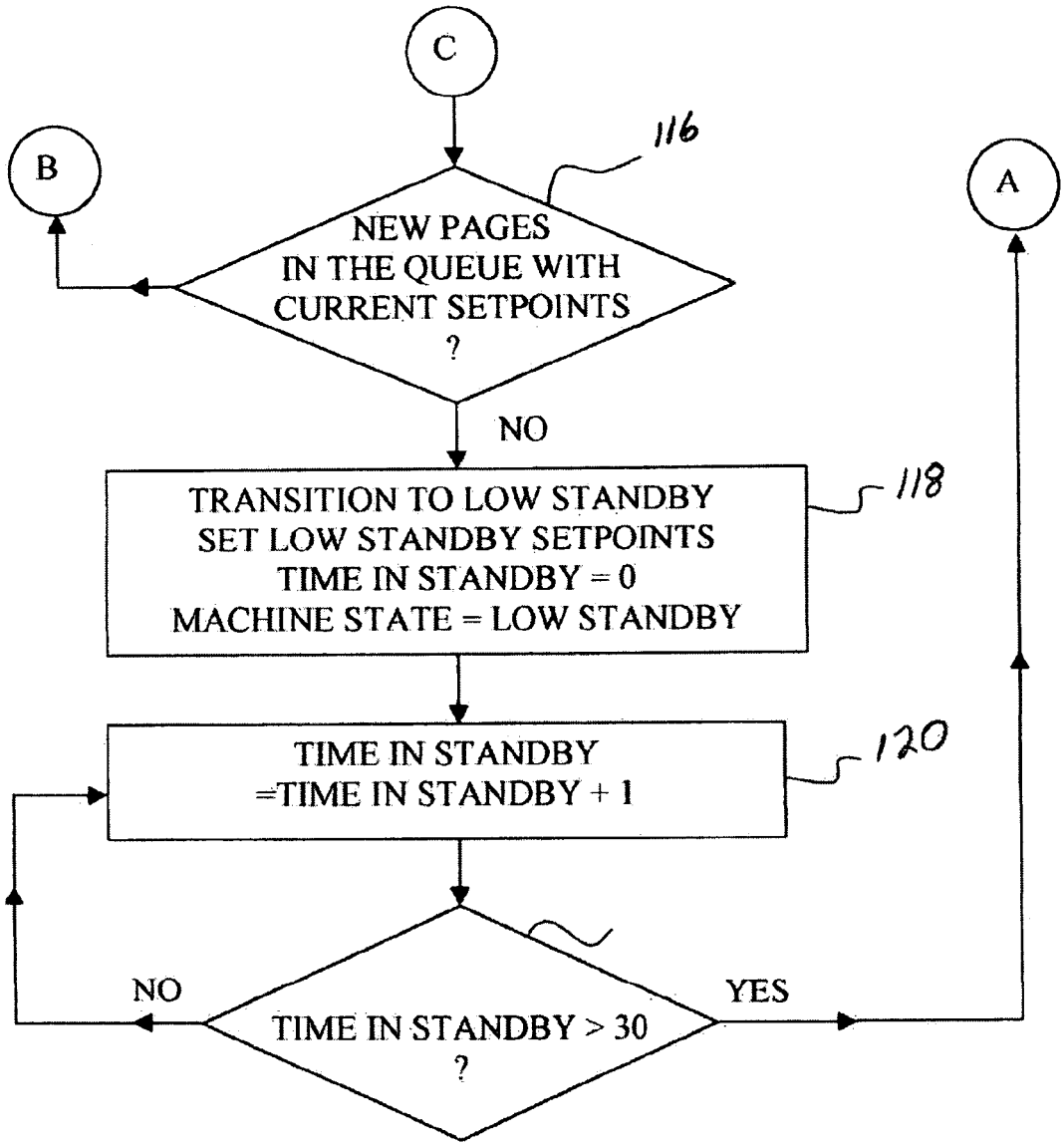

A flow chart of the algorithm 100 for standby temperature control is shown in FIGS. 3A and 3B. From a condition of elevated standby temperature 102, following power ring on the printer (POR), the print engine is queried at 104 to determine if a print job has been received. If not, controller 66 and temperature sensor 64 cooperate to maintain the temperature of elastomeric cover 62 at the elevated standby temperature. If a print job has been received, a normal print logic routine 106 is activated, including the determination of the media type being processed and the required target temperature for heated roller 54. Job and page information 108 from the print queue is read. When a query 110 determines that four or fewer pages remain, the overshoot logic 112 is posted. So long as additional pages remain in the queue for printing and fusing, droop elimination logic 114 is active. Upon a determination from a query 116 that no new pages are present in the queue, controller 66 is switched to function together with temperature sensor 64 to provide activation of halogen lamp 58 only as necessary to maintain a first low standby temperature 118. Low standby temperature control 118 is maintained for thirty seconds using a timing logic 120, and upon a lapse of the thirty second time period, controller 66 is switched to function together with temperature sensor 64 for the activation and deactivation of halogen lamp 54 to provide an elevated standby temperature for elastomeric cover 62.

The present invention minimizes the effects of both overshoot and droop when process short print jobs. Elevated standby or startup temperatures delay heater startup until closer to the end of small printjobs, to reduce overshoot normally caused by the thermal inefficiencies in heated roll structures of fusers. At the same time, the elevated startup or standby temperature reduces the experience of temperature droop at the start of a printjob. Two level standby control takes into consideration heating delays on the roll surface at the end of a printjob.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for fusing toner on media in an electrophotographic printing apparatus having a fuser with a heated roll including a heater, and a backing apparatus between which individual pieces of media pass in a fusing operation performed at a temperature within a temperature range between a maximum temperature and a minimum temperature, the temperature range including a first maximum target temperature, said method comprising steps of:

heating the heated roll to a preheated temperature within the temperature range, the preheated temperature being in excess of the first maximum target temperature;

interrupting power to said heater to interrupt said heating prior to commencement of a fusing operation;

commencing the fusing operation by passing media between the heated roll and the backing structure; and initiating reheating of the heated roll during the fusing operation only upon a temperature of the heated roll dropping below the first maximum target temperature.

2. The method of claim 1, including further steps of:

counting individual pieces of media processed in a print job; and after a predetermined number of pieces of media having been processed, initiating heating of the heated roll only upon a temperature thereof dropping below a second target temperature lower than the first maximum target temperature.

3. The method of claim 2, including controlling a standby temperature of the heated roll during a standby period between completing a first print job and before commencement of a second print job, said step of controlling the standby temperature including reheating the heated roll to the standby temperature during the standby period, the standby temperature of the heated roll being higher than the first maximum target temperature.

4. The method of claim 3, including delaying said reheating of the heated roll during the standby period for a predetermined time period following completion of the first print job.

5. The method of claim 4, the preheated temperature and the standby temperature being substantially the same.

6. The method of claim 1, including controlling a standby temperature of the heated roll during a standby period between completing a first print job and before commencement of a second print job, said step of controlling the standby temperature including reheating the heated roll to the standby temperature during the standby period, the standby temperature of the heated roll being higher than the first maximum target temperature.

7. The method of claim 6, including delaying said step of reheating the heated roll during the standby period for a predetermined time period following completion of the first print job.

8. The method of claim 6, the preheated temperature and the standby temperature being substantially the same.

9. The method of claim 8, including delaying said step of reheating the heated roll during the standby period for a predetermined time period following completion of the first print job.

10. The method of claim 1, the preheated temperature being at least about 5° C. greater than the first maximum target temperature.

11. The method of claim 10, including elevating the temperature of the heated roll to a standby temperature between completing a first print job and commencing a second print job, the standby temperature being greater than the first maximum target temperature.

12. The method of claim 11, the standby temperature being at least about 5° C. greater than the first maximum target temperature.

13. A temperature control method for a fuser having a temperature range for proper fusing and a maximum target temperature within the range, said method comprising steps of:

providing a heated roll, a heater and a temperature sensor;

determining completion of a first print job processed in the fuser;

sensing a temperature of the heated roll and maintaining the temperature of the heated roll at a low standby temperature during a standby period between the completion of the first print job and commencement of a second print job; and activating the heater during the standby period to elevate the temperature of the heated roll to an elevated standby temperature within the temperature range, the standby temperature being greater than the maximum target temperature.

14. The method of claim 13, wherein the elevated standby temperature is at least about 5° C. greater than the maximum target temperature.

15. The method of claim 13, including delaying said step of activating the heater to elevate the temperature of the heated roll to the elevated standby temperature during the standby period for a delay period following completion of the first print job.

16. The method of claim 15, wherein the elevated standby temperature is at least about 5° C. greater than the maximum target temperature.

17. The method of claim 15, said step of delaying being about thirty seconds.

18. The method of claim 17, wherein the elevated standby temperature is at least about 5° C. greater than the maximum target temperature.

19. A temperature control procedure for a fuser in an electrophotographic printing apparatus having a fuser roll and a heater for heating the fuser roll, said control procedure comprising the steps of:

initiating startup of the fuser by heating the fuser roll to a preheat temperature within a temperature range for successful fusing;

commencing fliser operations by passing media through the fuser against the fuser roll;

supplying additional energy for heating the heated roll only upon the temperature thereof falling below a target temperature lower than the preheat temperature; and heating the heated roll to a standby temperature during a standby period between completion of a first print job and commencement of a subsequent print job, the standby temperature being within the temperature range and being greater than the first target temperature wherein said heating during said standby period is delayed for a delay period following completion of the first print job.

20. The procedure of claim 19, the standby temperature being substantially the same as the preheat temperature.

21. The procedure of claim 19, the delay period being approximately 30 seconds.

* * * * *